US008249476B2

(12) United States Patent
Okumura

(10) Patent No.: US 8,249,476 B2
(45) Date of Patent: Aug. 21, 2012

(54) IMAGE FORMING APPARATUS AND METHOD OF CONTROLLING IMAGE FORMING APPARATUS

(75) Inventor: Yasuhiko Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 12/796,153

(22) Filed: Jun. 8, 2010

(65) Prior Publication Data

US 2010/0329713 A1 Dec. 30, 2010

(30) Foreign Application Priority Data

Jun. 25, 2009 (JP) ..... 2009-151520

(51) Int. Cl.
*G03G 15/02* (2006.01)

(52) U.S. Cl. ..... 399/50

(58) Field of Classification Search ..... 399/50, 399/174, 175, 176, 168; 361/221; 430/902
See application file for complete search history.

(56) References Cited

U.S. PATENT DOCUMENTS

| | | | | |
|---|---|---|---|---|
| 7,778,560 | B2 * | 8/2010 | Ishibashi et al. | 399/50 |
| 2007/0059000 | A1 * | 3/2007 | Shibuya | 399/50 X |
| 2010/0239286 | A1 * | 9/2010 | Hanashi | 399/50 |

FOREIGN PATENT DOCUMENTS

| | | | |
|---|---|---|---|
| JP | 2006-267739 | A | 10/2006 |
| JP | 2006-276054 | A | 10/2006 |
| JP | 2007-199094 | A | 8/2007 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus has a charging unit which charges an image carrier by applying a voltage to a charging member arranged to be in contact with the image carrier. The image forming apparatus includes an alternating voltage applying unit which generates an alternating voltage, a first voltage detection unit which detects a positive peak voltage of the alternating voltage, a second voltage detection unit which detects a negative peak voltage of the alternating voltage, a voltage amplitude determination unit which determines an amplitude value of the alternating voltage based on the positive peak voltage detected, and an alternating voltage control unit which outputs a signal which changes an output from the alternating voltage applying unit.

16 Claims, 9 Drawing Sheets

IMAGE FORMING APPARATUS AND METHOD OF CONTROLLING IMAGE FORMING APPARATUS

BACKGROUND OF THE INVENTION

1. Field of the Invention

The present invention relates to an image forming apparatus and a method of controlling an image forming apparatus.

2. Description of the Related Art

As an image forming apparatus based on an electrophotography process that outputs a color image, an apparatus having a schematic arrangement shown in FIG. 1 is known. Referring to FIG. 1, reference numerals 1*a* to 1*d* denote photosensitive members as image carriers; 2*a* to 2*d*, chargers; 3*a* to 3*d*, exposure units; and 4*a* to 4*d*, developers. Reference numerals 53*a* to 53*d* denote primary transfer units; 6*a* to 6*d*, cleaners; 51, an intermediate transfer belt; 55, an intermediate transfer belt cleaner; and 56 and 57, secondary transfer units. After the surfaces of the photosensitive members 1*a* to 1*d* are uniformly charged by the chargers 2*a* to 2*d*, electrostatic latent images are formed on the photosensitive members 1*a* to 1*d* by exposure processes made by the exposure units 3*a* to 3*d* according to image signals. After that, the electrostatic latent images are developed by the developers 4*a* to 4*d* to form toner images. The toner images on the four photosensitive members 1*a* to 1*d* are multiple-transferred onto the intermediate transfer belt 51 by the primary transfer units 53*a* to 53*d*, and are further transferred onto a print material P by the secondary transfer units 56 and 57. Transfer residual toners which remain on the photosensitive members 1*a* to 1*d* are recovered by the cleaners 6*a* to 6*d*, and that which remains on the intermediate transfer belt is recovered by the intermediate transfer belt cleaner 55. The toner images transferred onto the print material P are fixed by a fixing unit 7, thus obtaining a color image.

Conventionally, for the chargers 2*a* to 2*d*, it is a common practice to use a corona charging method as a non-contact charging method, which charges by impinging, on the photosensitive member surface, a corona generated by applying a high voltage to a thin corona discharge wire. In recent years, a contact charging method which is advantageous in terms of a low-voltage process, small ozone generation amount, low cost, and the like is prevailing.

FIG. 2 shows a model of the chargers 2*a* to 2*d*. An alternating voltage output circuit 28 outputs an alternating output voltage Vac, and a direct-current voltage output circuit 29 outputs a direct-current output voltage Vdc. A voltage charged on the photosensitive member surface by a voltage obtained by superposing the alternating output voltage Vac and direct-current (DC) output voltage Vdc is Vd. In this method, a roller charging member (to be referred to as "charging roller" hereinafter) is brought into contact with the photosensitive member surface, and a voltage is applied to this charging roller to charge the photosensitive member. A voltage applied to the charging roller may be purely a direct-current voltage. However, by superposing an alternating-current (AC) voltage (hereinafter an alternating voltage) on a direct-current voltage to alternately cause discharge processes to the plus and minus sides, a charging process can be uniformly done. As is experimentally confirmed, the relationship among the alternating voltage Vac, direct-current voltage Vdc, and photosensitive member surface potential Vd is as shown in FIG. 3.

That is, by gradually raising the amplitude of the alternating voltage Vac, the photosensitive member surface potential Vd increases accordingly. When the alternating voltage Vac is less than or equal to a predetermined voltage Vac_s, the amplitude of the alternating voltage is nearly proportional to the photosensitive member surface potential. When the alternating voltage Vac is greater than or equal to the predetermined voltage Vac_s, the photosensitive member surface potential Vd matches the direct-current voltage Vdc. Note that Vac represents peak voltage values of the alternating voltage. FIG. 4 shows an electric model of a contact between the charging roller and photosensitive member. As a result of rotation, a contact surface between the charging roller and photosensitive member can be modeled by a capacitive load and resistance connected in series with each other (FIG. 4). It is considered that a discharge phenomenon between the charging roller and photosensitive member contributes to the result shown in FIG. 3. However, in terms of an electric circuit model of the kind shown in FIG. 4, it is considered that increasing the alternating voltage Vac has the effect of lowering an impedance between the charging roller and photosensitive member.

When alternating voltage applied to the charging roller is in the form of a sine wave, a current supplied to the charging roller depends on a capacitive load between the charging roller and photosensitive member and an impedance based on a resistance that changes under the influence of the alternating voltage Vac. FIG. 5 is a graph showing the characteristics of a direct-current Idc that flows through the charging roller when the alternating voltage Vac is applied to the charging roller. By gradually raising the amplitude of the alternating voltage Vac, the direct-current Idc decreases accordingly. When the alternating voltage Vac is less than or equal to a predetermined voltage Vac_s, the amplitude of the alternating voltage is nearly proportional to the direct current. This is because the direct-current voltage Vdc applied to the charging roller and the potential Vd of the photosensitive member have a potential difference, and a charge current Idc corresponding to the potential difference and a load impedance 40 is supplied. In order to stably apply a voltage, which is applied to the charging roller, and also to the photosensitive member while the charging roller contacts the photosensitive member, an amplitude of the alternating voltage should be sufficient to lower the load impedance 40 so as to sufficiently charge a capacitance component of the charging roller/photosensensitive body until Vd=Vdc.

As can be seen from the above description, when the alternating voltage Vac is greater than or equal to a saturation value Vac_s, beyond which there is no increase in direct current Idc in FIG. 5 even if the alternating voltage increases, the photosensitive member surface potential Vd matches the direct-current voltage Vdc. However, as is known, when the amplitude of the alternating voltage Vac is increased, a degradation of the photosensitive member tends to cocur, and at least in a high-temperature, high-humidity environment an abnormal image due to a discharge product tends to be generated. In order to obtain stable charging and to solve the aforementioned problems, a photosensitive member stable potential (Vd=Vdc) has to be obtained by applying a minimum required alternating voltage Vac. However, in practice, the relationship between the alternating voltage Vac applied to the photosensitive member and the direct current Idc is not constant, and changes depending on the film thicknesses of a photosensitive member layer and dielectric layer of the photosensitive member, environmental variations of a charging member and air, and the like. In a low-temperature, low-humidity environment, since the materials of the charging roller are dried, and a resistance increases, the alternating voltage Vac greater than or equal to a given value is required to attain uniform charging. However, even at a lowest voltage value that can obtain charging uniformity in this low-temperature, low-humidity environment, when a charging operation is made in a high-temperature, high-humidity environment, the materials of the charging roller absorb moisture, and the resistance lowers conversely. For this reason, the charging member receives an excessive alternating voltage Vac.

As a result, when the alternating voltage Vac increases, problems of generation of image errors, occurrence of toner fusion, shaving and short lifetime of the photosensitive member due to degradation of the photosensitive member surface, and the like occur. Troubles caused by impedance change characteristics due to the alternating voltage Vac occur due to other factors other than the aforementioned environmental variations. For example, as has already been revealed, the aforementioned troubles are also caused by resistance variations due to manufacturing variations and contaminations of the charging member, capacitance variations of the photosensitive member due to lasting, characteristic variations of a high-voltage generation device in an image forming apparatus, and the like. In order to suppress adverse effects due to excess or deficiency of the alternating voltage Vac, a method of deriving Vac_s is disclosed by Japanese Patent Laid-Open Nos. 2006-276054, 2007-199094, and 2006-267739. Japanese Patent Laid-Open Nos. 2006-276054 and 2007-199094 have proposed a method of deriving Vac_s by calculating Vac-Idc characteristics at the time of unsaturation by measuring Idc using a plurality of Vac values in an Idc unsaturation region, and measuring a saturated current Idc in a saturation region. Also, Japanese Patent Laid-Open No. 2006-267739 has proposed a method of deciding Vac by deriving Vac_s by sweeping Vac from a small value to a large value while detecting Idc.

However, these conventional methods suffer the following problems.

(1) Derivation of the Vac-Idc characteristics by means of plural-point measurements requires a voltage higher than the alternating application voltage Vac used in an actual image forming sequence. This will be described using FIG. 5. Since Vac_s and a saturated current Idc_s as change points of the characteristics vary due to various variation factors, a predetermined Vac value has to be instructed and Idc corresponding to that value has to be detected, so as to derive the characteristics. In order to derive the characteristics shown in FIG. 5, a minimum requirement is to derive primary characteristics from Vac and Idc data at least at two points A and B shown in FIG. 5 using a voltage smaller than Vac_s. Also, Idc of data C at least at one point shown in FIG. 5 using a voltage larger than Vac_s is required. Vac_s can be derived from a straight line derived from A and B and a current value Idc_s at the point C. However, the characteristics based on a value larger than Vac_s are detected using a voltage about 1.5 times of a voltage used in a charging operation since a voltage higher than Vac_s and a sufficiently stable value are required in every environment. A power supply which can sufficiently supply a current at this voltage inevitably requires an increase in size of a high-voltage power supply.

(2) Derivation of a change in Idc by sweeping Vac requires a memory and judgment algorithm since Idc change records have to be derived.

(3) As exemplified in (1), derivation of the characteristics requires much time since an unknown change point Vac_s and known magnitude Idc_s have to be searched.

SUMMARY OF THE INVENTION

It is desirable to solve one or more of the problems described above. It is also desirable to provide an image forming technique which can stably maintain high image quality and high quality over the long term irrespective of characteristics variations and the like of a charging member due to environmental conditions and manufacture.

The present invention in its first aspect provides an image forming apparatus comprising: an image carrier; a charging member arranged to be in contact with the image carrier; an AC voltage applying unit adapted to apply an AC voltage to the charging member; a comparison unit adapted to compare positive-going and negative-going elements (Vp+, Vp−) of an AC component of a potential (V) of the charging member, or of a current flowing through the charging member, when the AC voltage is applied thereto; and an AC voltage control unit adapted to control an amplitude of the AC voltage based on a result of the comparison by the comparison unit.

The present invention in its second aspect provides a method of controlling an image forming apparatus having an image carrier and a charging member arranged to be in contact with the image carrier, the method comprising: applying an AC voltage to the charging member; comparing positive-going and negative-going elements (Vp+, Vp−) of an AC component of a potential (V) of the charging member, or of a current flowing through the charging member, when the AC voltage is applied thereto; and controlling an amplitude of the AC voltage based on a result of the comparison by the comparison unit.

In an embodiment of the present invention, high image quality can be stably maintained over the long term by applying an alternating voltage of a satisfactory amplitude to a charging roller irrespective of characteristics variations and the like of a charging member due to environmental conditions and manufacture.

Further features of the present invention will become apparent from the following description of exemplary embodiments (with reference to the attached drawings).

DESCRIPTION OF THE EMBODIMENTS

Embodiments of the present invention will be exemplarily described in detail hereinafter with reference to the drawings.

(First Embodiment)

Figure 6:
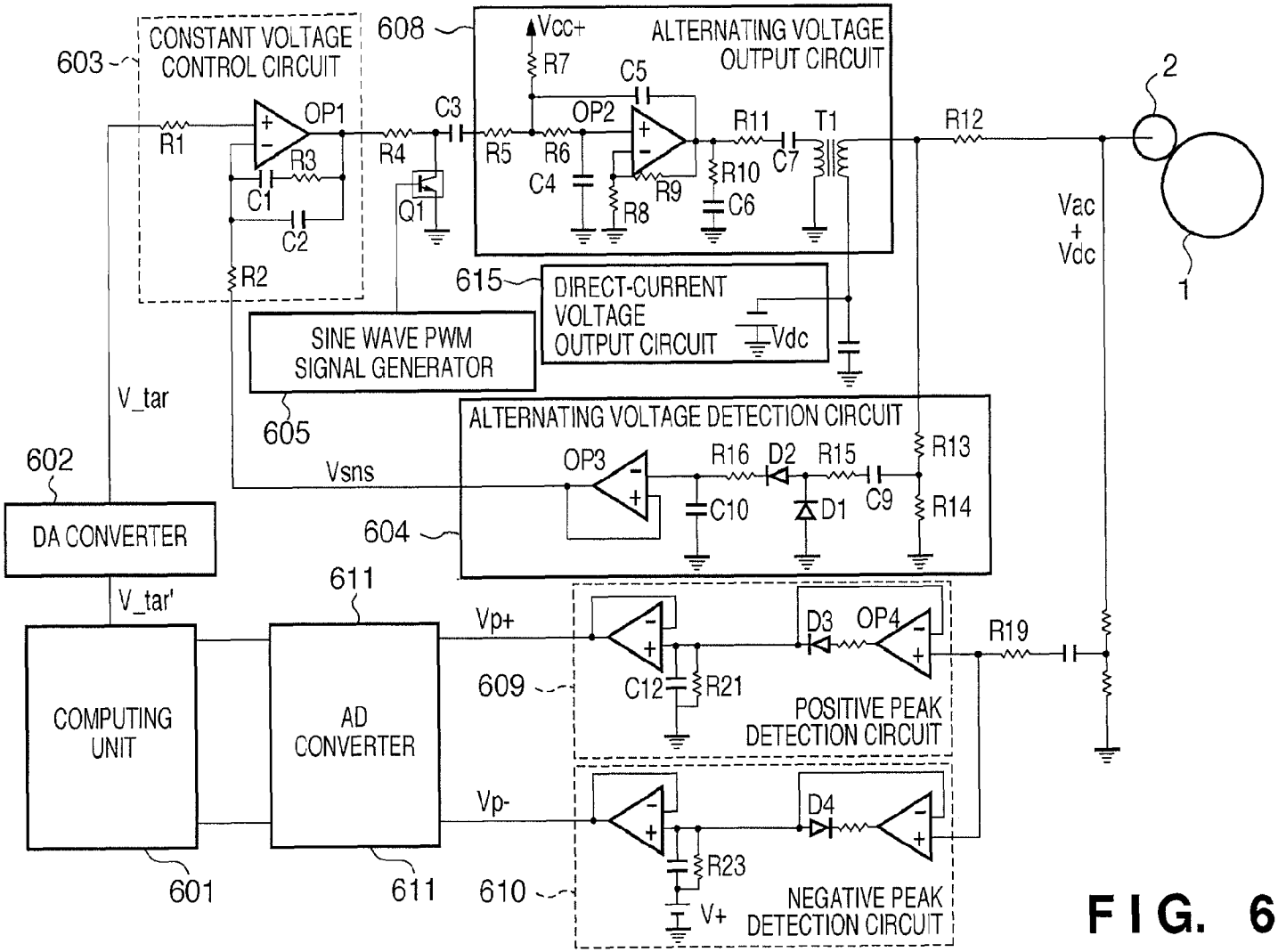
FIG. 6 is a schematic circuit diagram showing the arrangement of a charger in an image forming apparatus according to the first embodiment of the present invention.

An image forming apparatus according to an embodiment of the present invention has a charger which charges an image carrier by applying a voltage to a charging member arranged to be in contact with the image carrier. FIG. 6 is a schematic circuit diagram showing the arrangement of the charger in the image forming apparatus according to the first embodiment of the present invention.

A computing unit 601 serving as a voltage amplitude control unit has a digital computing device such as a CPU or DSP, and can decide an amplitude value of an alternating voltage to be applied to a charging member. A voltage instruction value V_tar' output from the computing unit 601 is converted into a corresponding analog signal V_tar via a DA converter 602, and is input to a constant voltage control circuit 603. The constant voltage control circuit 603 includes resistors R1, R2, and R3, capacitors C1 and C2, and an operational amplifier OP1. A feedback loop including the constant voltage control circuit 603 controls the amplitude value of the alternating voltage so that a voltage instruction value V_tar matches Vsns input from an alternating voltage detection circuit 604. The output signal from the operational amplifier OP1 is converted into a rectangular wave when it is chopped, via a resistor R4, by a transistor Q1 by a sine wave PWM signal (a carrier wave=1 kHz and a modulated wave=50 kHz) output from a sine wave PWM signal generator 605. Note that the sine wave PWM signal means a PWM signal (rectangular wave signal) whose pulse width is varied so as to approximate the rectangular wave signal to a sine wave. An alternating component is input to an alternating voltage output circuit 608 via a capacitor C3. Note that the alternating voltage output circuit 608 serves as an alternating voltage applying unit which generates an alternating voltage to be applied to the charging member based on an input voltage value, and applies the alternating voltage to the charging member.

Figure 7A:
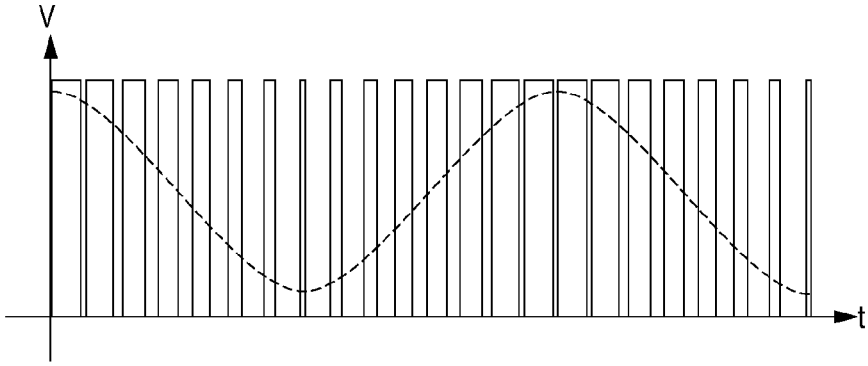
FIG. 7A is a chart exemplarily showing a voltage waveform of a sine wave PWM signal.
Figure 7B:
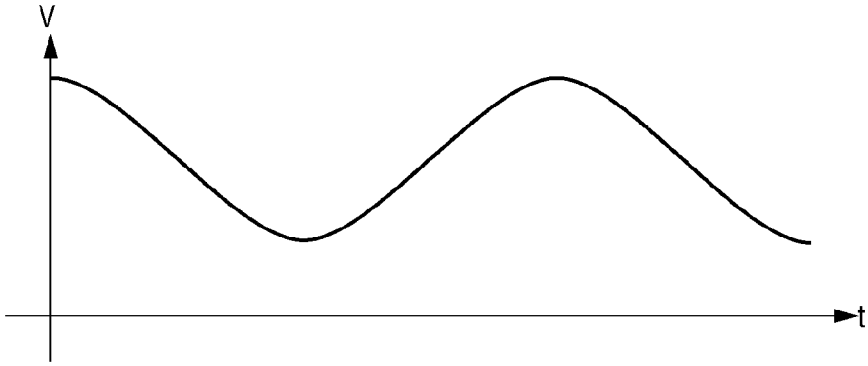
FIG. 7B is a graph exemplarily showing a waveform of an OP2 output signal (voltage)
Figure 7C:
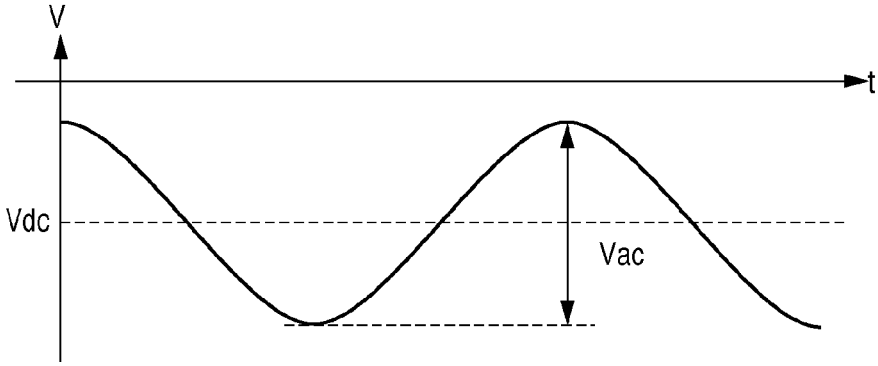
FIG. 7C is a graph exemplarily showing a voltage waveform obtained by superposing an alternating voltage Vac on a direct-current voltage Vdc.

FIG. 7A is a chart exemplarily showing a voltage waveform of the sine wave PWM signal. The solid lines indicate the sine wave PWM signal, and the broken curve indicates a carrier wave. In practice, 50 PWM pulses are generated per cycle of the carrier wave, but FIG. 7A expresses the PWM signal by 16 pulses. Resistors R5, R6, R7, R8, and R9, capacitors C4 and C5, and an operational amplifier OP2 form a secondary low-pass filter for an input signal to the resistor R5. This low-pass filter allows a fundamental wave of a rectangular wave based on the sine wave PWM signal to pass through it, and cuts off harmonics. The alternating voltage output circuit 608 has a positive power supply potential Vcc+ and generates, based on the input signal, an alternating signal which is offset from the positive power supply potential Vcc+. An alternating component of an output signal of the operational amplifier OP2 (FIG. 7B) is applied to the primary winding of a high-voltage transformer T1 via resistors R10 and R11 and capacitors C6 and C7. A turn ratio of the transformer T1 is, for example, 1:120. An alternating voltage Vac output from a secondary winding of the high-voltage transformer T1 via resistor R12 is variable within an amplitude range from 0 V to 1250 V according to the instruction value V_tar, and is applied to a charging roller 2 after being overlaid (superposed) on a direct-current voltage Vdc output from a direct-current voltage output circuit 615. FIG. 7C shows a voltage applied to the charging roller. In this embodiment, Vdc is a negative direct-current voltage. On the charging roller, since the alternating voltage Vac is superposed on the direct-current voltage Vdc, a mean value of a photosensitive member surface potential Vd equals the direct-current voltage Vdc.

The alternating voltage detection circuit 604 includes resistors R13, R14, R15, and R16, capacitors C9 and C10, diodes D1 and D2, and an operational amplifier OP3, and detects only an alternating component by the capacitor C9. The alternating voltage detection circuit 604 rectifies and smoothes an output alternating voltage of the high-voltage transformer T1, and outputs that voltage as an alternating voltage detection signal Vsns to the constant voltage control circuit 603. With the series of operations described above, constant voltage control of an output alternating voltage having an amplitude that matches the voltage instruction value V_tar' is achieved.

The constant voltage control circuit 603 and alternating voltage detection circuit 604 serve as an alternating voltage control unit. The alternating voltage detection circuit 604 detects an alternating voltage output from the alternating voltage output circuit 608. The constant voltage control circuit 603 can control a voltage value input to the alternating voltage output circuit 608, so that the alternating voltage becomes a waveform having an amplitude value controlled by the computing unit 601.

A positive peak detection circuit 609 serving as a first voltage detection unit and a negative peak detection circuit 610 serving as a second voltage detection unit respectively detect a positive peak voltage and negative peak voltage of the alternating voltage via a resistor R12 from the output of the transformer T1. In the positive peak detection circuit 609, when an input signal from a resistor R19 exceeds a potential of a capacitor C12, an output from an operational amplifier OP4 goes HIGH, and the potential of the capacitor C12 becomes equal to a +terminal input voltage of the operational amplifier OP4. Conversely, when the input signal from the resistor R19 falls below the potential of the capacitor C12, the output from the operational amplifier OP4 goes LOW. In this case, a diode D3 is reverse-biased, and the capacitor C12 maintains its potential. With this principle, the positive peak detection circuit 609 holds a positive peak value of the alternating voltage. A resistor R21 connected in parallel with the capacitor C12 is a discharge resistor. The resistor R21 and capacitor C12 are chosen so that at the frequency of the alternating voltage Vac, which in this embodiment is 1 kHz, the voltage across the capacitor C12 remains substantially constant at the positive peak value of the alternating voltage. Differences between the negative peak detection circuit 610 and positive peak detection circuit 609 are that the directions of the diode D3 and a diode D4 are opposite to each other, a power supply which has the effect of offseting an output voltage from a positive value V+ is included, and a negative peak equivalent value of an alternating voltage is held.

A principle of deriving an appropriate alternating voltage amplitude Vac from the positive and negative peak values will be described below. Originally, an alternating voltage does not directly contribute to a direct current. However, by applying an alternating voltage, a discharge phenomenon tends to occur more readily. A potential difference between the surface potential Vd of the photosensitive member and a potential Vdc+Vac of the charging roller 2 applied by the alternating voltage output circuit 608 and direct-current voltage output circuit 615 becomes larger than that in case of only Vd and Vdc, thus easily causing a discharge phenomenon.

Figure 1:
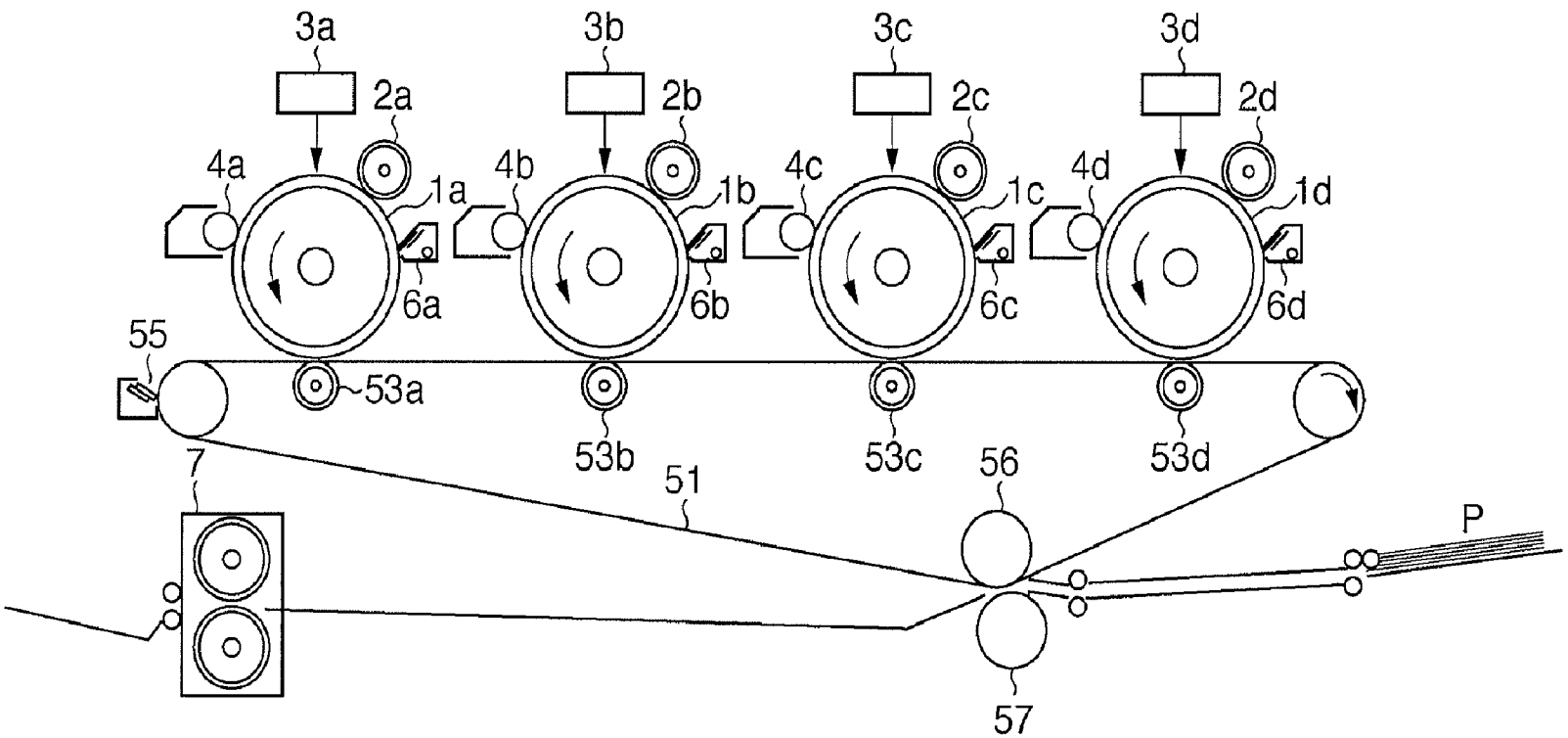
FIG. 1 is a view showing an example of the arrangement of an image forming apparatus based on an electrophotography process that outputs a color image.
Figure 2:
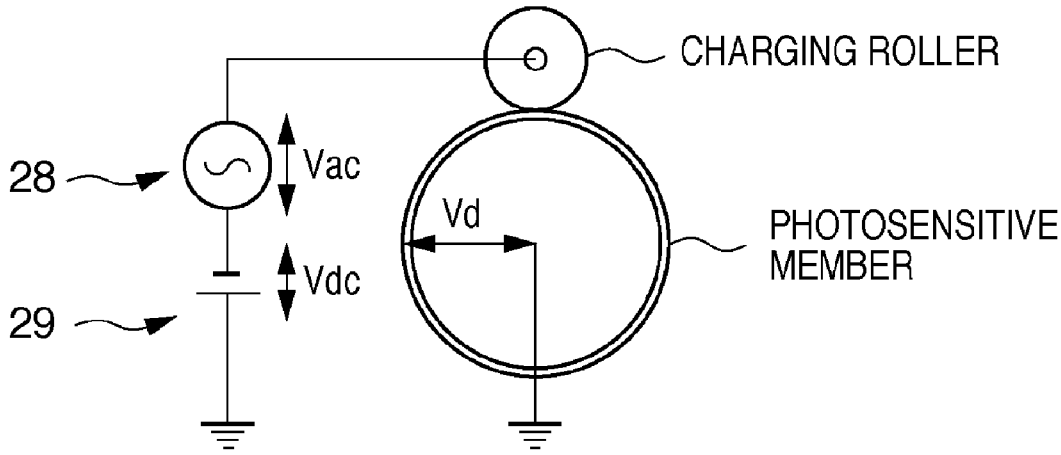
FIG. 2 shows a model of chargers 2*a* to 2*d;*
Figure 3:
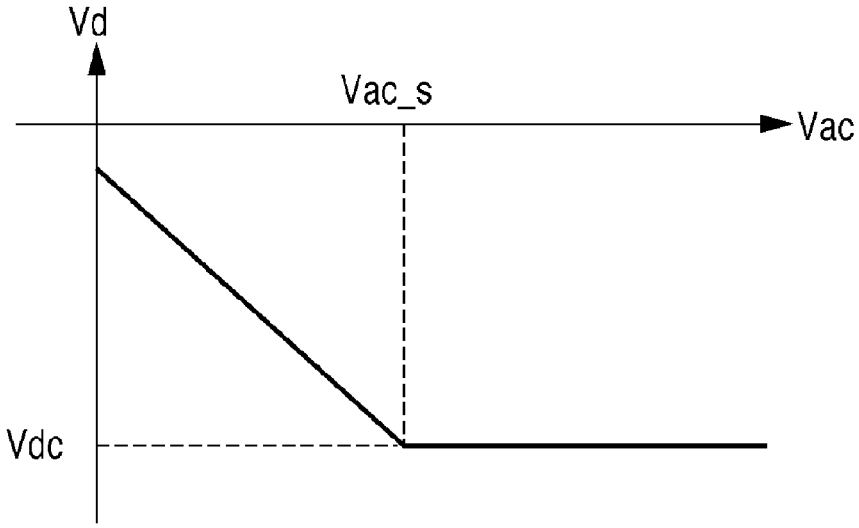
FIG. 3 is a graph showing the relationship among an alternating voltage Vac, direct-current voltage Vdc, and photosensitive member surface potential Vd.
Figure 4:
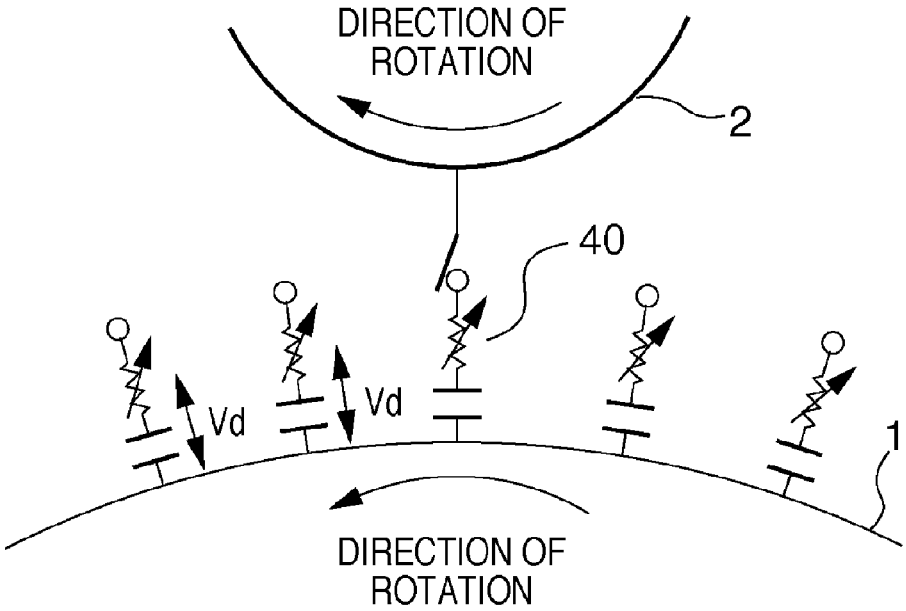
FIG. 4 shows an electric model of a contact between a charging roller and photosensitive member.
Figure 5:
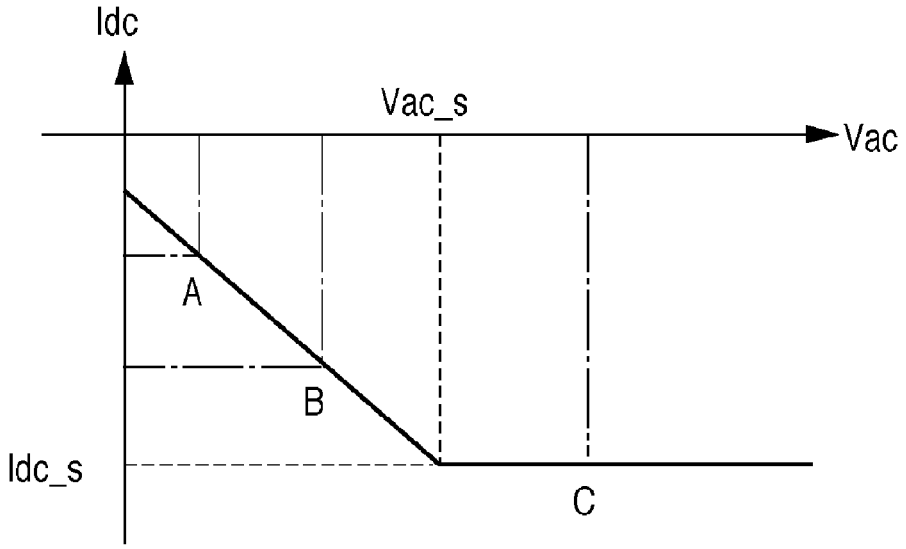
FIG. 5 is a graph showing an example of the characteristics of a direct current Idc that flows through a charging roller when an alternating voltage Vac is applied to the charging roller.

Upon examining the discharge phenomenon using the model shown in FIG. 4, when a discharge process takes place on and around a contact surface between the charging roller and photosensitive member, a variable resistance drop, that is, an impedance drop occurs to result in the characteristics shown in FIG. 5 with respect to a direct current. FIGS. 8A to 8D show this phenomenon as potentials on a time axis.

Figure 8A:
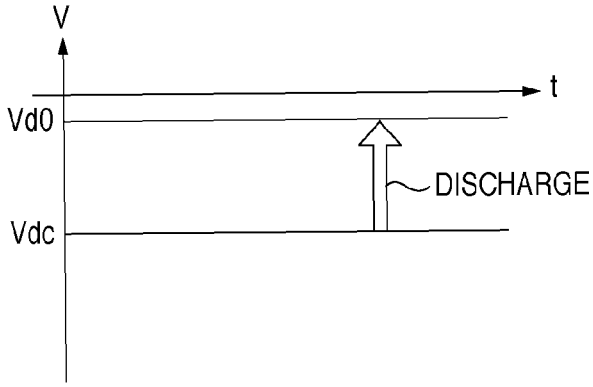
FIGS. 8A to 8D are graphs exemplarily showing the principle of an amplitude change of an alternating voltage.
Figure 8B:
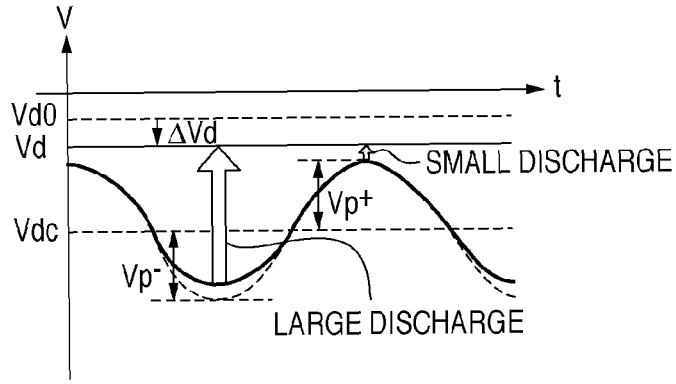
Figure 8C:
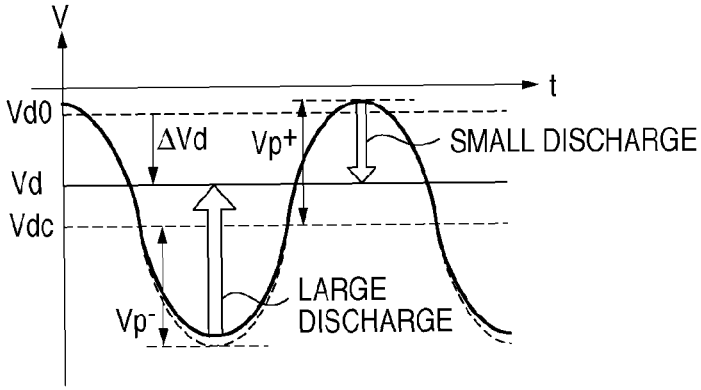
Figure 8D:
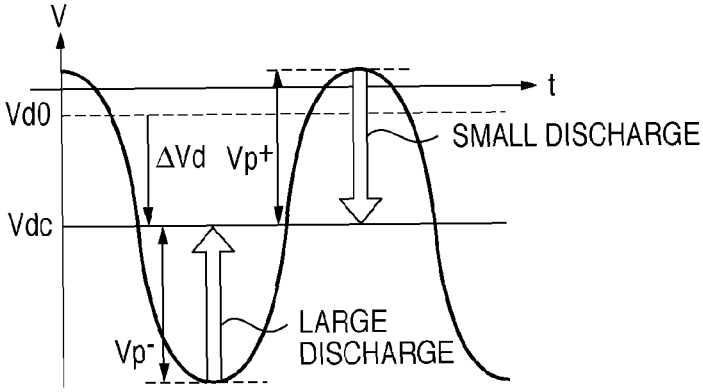

FIG. 8A shows the relationship between Vdc and Vd when Vac=0. Even in case of Vdc alone, a current flows by a small discharge, and the photosensitive member is charged to Vd0. FIGS. 8B, 8C, and 8D show waveforms obtained by superposing Vac on the waveform shown in FIG. 8A. The amplitude shown in FIG. 8B<that shown in FIG. 8C<that shown in FIG. 8D. In FIG. 8B, a potential difference between Vd and Vdc+Vac becomes larger than that in FIG. 8A when a voltage of Vac is negative, thus generating a large discharge in the case of a negative-going element of the AC component of the charging-member potential. Thus, a discharge amount increases, and accordingly it can be considered that an average value of a load impedance 40 shown in FIG. 4 lowers. Hence, Vd changes by ΔVd compared to FIG. 8A.

Upon being transiently examined, when Vac is in the vicinity of Vp−, since a voltage division ratio with the resistor R12 changes due to a change in load impedance 40 defined by the charging roller 2 and a photosensitive member 1 in FIG. 6, an amplitude value of Vp− is smaller than the amplitude of Vp+. Note that a waveform indicated by the broken curve in FIG. 8B is a postulated curve in which it is assumed that Vp− is equal to Vp+. However, because the load impedance 40 can be considered to have changed to a lower value as a result of the alternating voltage Vac, at least for negative-going elements of the AC component of the charging-member potential, the actual negative peak value differs from the DC voltage Vdc by less than Vp+. In other words, the negative-going element of the AC component in FIG. 8B has a smaller amplitude than the positive-going element. FIG. 8C shows a waveform obtained when Vac is further increased. As in FIG. 8B, Vd changes by ΔVd because there is an even larger potential difference between the peak negative value of the AC component and Vd. Again, the broken curve in FIG. 8C is a postulated curve in which Vp− is equal to Vp+. As in FIG. 8B, the negative-going element of the actual AC component still has a smaller amplitude than the positive-going element but in the case of FIG. 8C the difference in the amplitudes of the positive- and negative-going elements is getting less. Also, in FIG. 8C a potential relationship between the peak positive value of the AC component and Vd is inverted, and a discharge phenomenon in a reverse direction begins to be generated. The discharges generated by the positive-going elements are still small relative to the discharges generated by the negative-going elements. Finally, FIG. 8D shows a case of Vac>Vac_s. In FIG. 8D, since Vd=Vdc, the potential differences Vp− and Vp+ are equal to one another and the discharge phenomena generated by the positive-going elements of the AC component are equal to the discharge phenomena generated by the negative-going elements of the AC component. That is, the load impedance 40 when the AC component of the charging-member potential has its peak negative value is equal to that when the AC component has its peak positive value, that is, Vp−=Vp+. With the above phenomena, we can consider:

When Vac<Vac_*s*, |Vp+|−|Vp−|>0

When Vac≧Vac_*s*, |Vp+|−|Vp−|=0

Figure 9A:
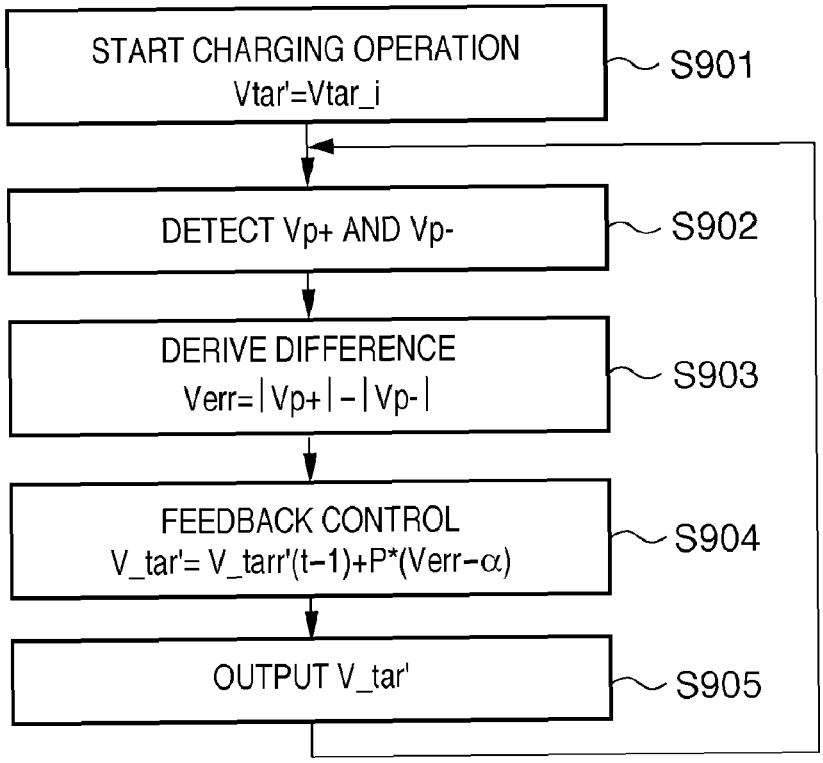
FIG. 9A is a flowchart showing the processing sequence of a computing unit 601 according to the first embodiment.

Using the aforementioned principle, the computing unit 601 executes processing shown in the flowchart of FIG. 9A during a charging operation on the photosensitive member 1 using values Vp+ and Vp− fetched via an AD converter 611 in FIG. 6. FIG. 9A is a flowchart for explaining the processing sequence of the computing unit 601 of the first embodiment.

When the user inputs a copy start operation instruction, a charging operation starts. The computing unit 601 instructs an initial target value V_tar'_i as a charging alternating voltage (S901). V_tar'_i is a value which is much smaller than Vac_s and results in Vdc>Vd. The computing unit 601 fetches Vp+ and Vp− values of an output voltage corresponding to V_tar'_i from the AD converter 611 (S902). The computing unit 601 derives a difference Verr between the fetched Vp+ and Vp− (S903). Then, the computing unit 601 determines a magnitude relationship between the difference Verr and a setting value α. The setting value α is set to be a small value that allows to detect Vd≈Vdc and Vp+>Vp−.

Figure 9B:
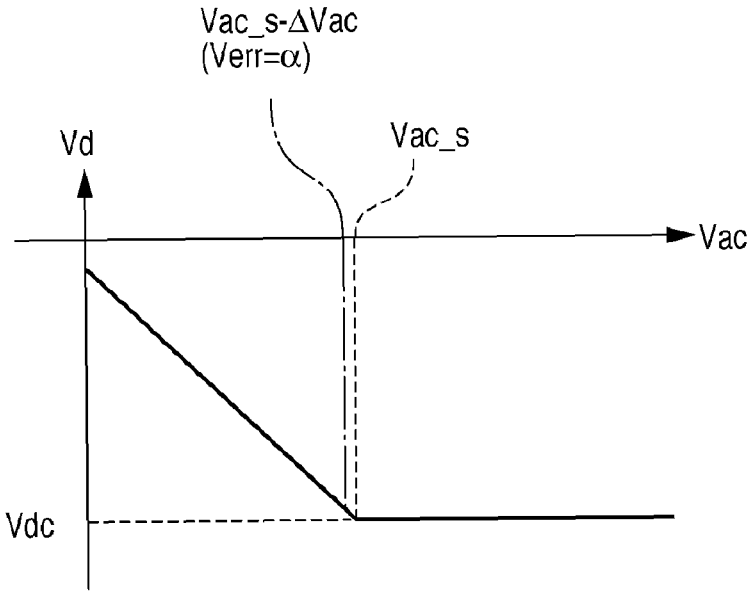
FIG. 9B is a graph for explaining an alternating voltage controlled by the computing processing shown in the flowchart of FIG. 9A.

If α<Verr, the computing unit 601 determines that Vac is deficient, and raises an alternating voltage amplitude target value V_tar' by a magnitude proportional to a difference between Verr and α. V_tar'(t−1) is V_tar' calculated by the previous computing processing, and P is a proportional gain. If α>Verr, the computing unit 601 determines that Vac is excessive, and lowers the alternating voltage amplitude target value V_tar' by a magnitude proportional to a difference between Verr and α. That is, the computing unit 601 controls the alternating voltage amplitude to attain Verr=α (S904). The computing unit 601 outputs the derived new target value V_tar' to the DA converter 602 (S905). Then, the process returns to step S902 to form a feedback loop including a power supply. The computing unit 601 controls to attain Verr=α, that is, Vac=Vac_s−ΔVac (0≈ΔVac≈0), thus obtaining stable Vd (≈Vdc). An alternating voltage controlled by the computing processing shown in the flowchart of FIG. 9A is Vac_s−ΔVac shown in FIG. 9B.

A charging high-voltage circuit according to this embodiment achieves the following effects.

(1) Since Vac does not require a magnitude of Vac_s+ΔV (ΔV≈0) or more even in consideration of overshoot in terms of control, an output power supply circuit having a performance more than an output used in the image forming sequence for Vac adjustment is not required.

(2) Since a control target value is the setting value α (fixed value) which does not depend on environments and variations, simple feedback control can be attained. For this reason, an appropriate charging potential Vd can be obtained by only executing feedback control without any storage unit, complicated arithmetic operations, and adjustment sequence.

Figure 10:
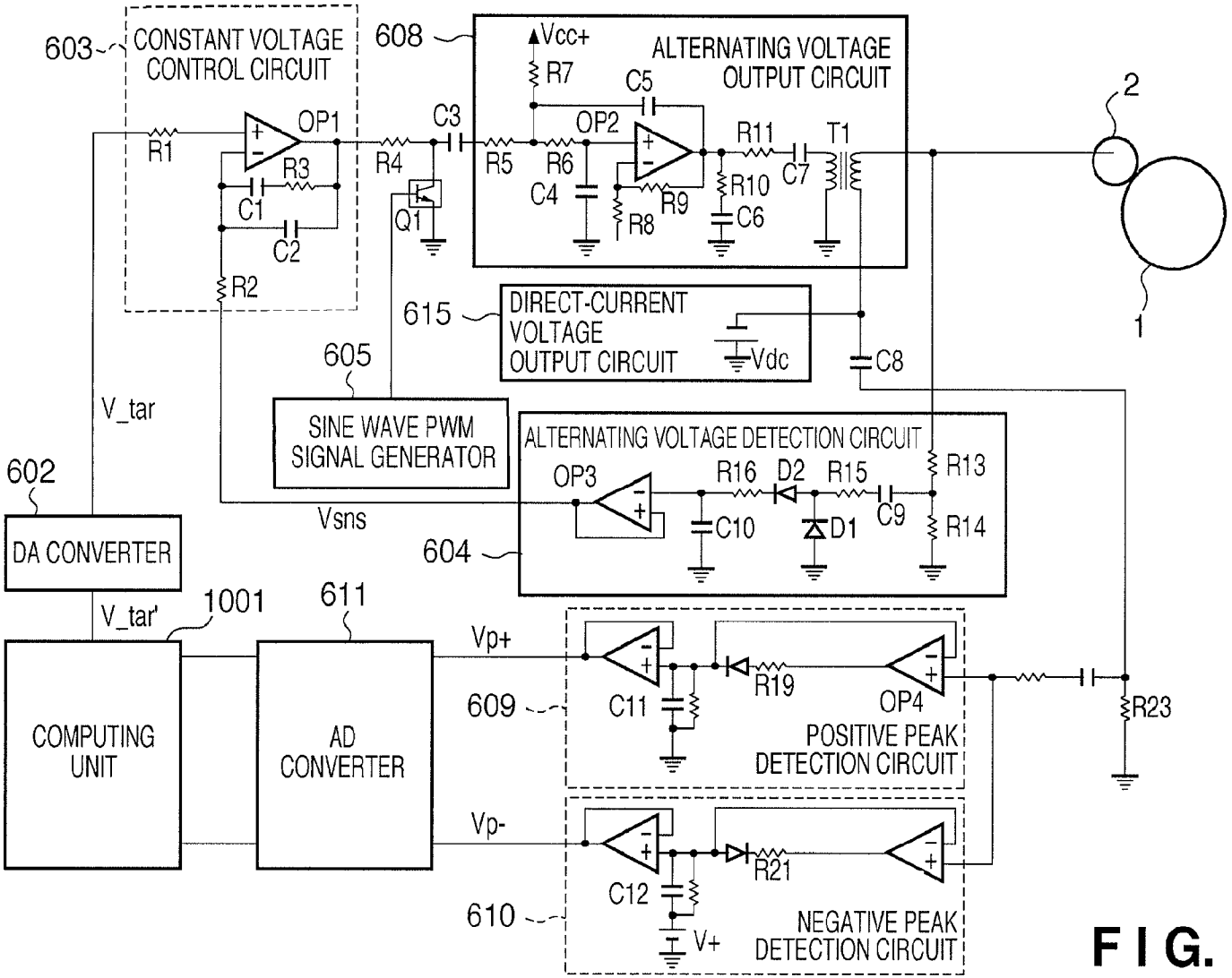
FIG. 10 is a schematic circuit diagram showing the arrangement of a charger in an image forming apparatus according to the second embodiment of the present invention.

Note that the load impedance 40 shown in FIG. 4 and Vp+ and Vp− of a voltage, which are voltage-divided by the resistor R12 are used. Alternatively, as shown in FIG. 10, the same computing processing can also be implemented by peak detection of a voltage generated by a current that flows through a resistor R23. In control sequence shown in FIG. 9A, the alternating voltage Vac is set by feedback control during the charging operation. During a period other than the charging operation, Vac corresponding to Verr=α is derived in advance, and the charging operation can use the derived Vac, as a matter of course. While the image carrier is charged after the beginning of image formation by an image forming process, the computing unit 601 decides an amplitude value so that a difference between positive and negative peak voltages equals the predetermined value α.

According to this embodiment, high image quality and high quality can be stably maintained over the long term by applying an alternating voltage of a satisfactory amplitude to the charging roller irrespective of characteristics variations and the like of the charging member due to environmental conditions and manufacture.

(Second Embodiment)

In the first embodiment, Vdc Vd is achieved by controlling to attain Vac corresponding to Verr=α. The second embodiment includes an adjustment sequence, and decides, as V_tar', a voltage obtained by adding an offset voltage β (adjustment voltage) to Vac which results in α>Verr>0. FIG. 10 is a schematic circuit diagram showing the arrangement of a charger in an image forming apparatus according to the second embodiment of the present invention, and the basic arrangement shown in FIG. 10 is the same as that shown in FIG. 6 of the first embodiment. Unlike in the first embodiment, an adjustment period is assured during a period different from a charging operation, and a computing unit 1001 executes an adjustment sequence of the flowchart shown in FIG. 11A.

Figure 11A:
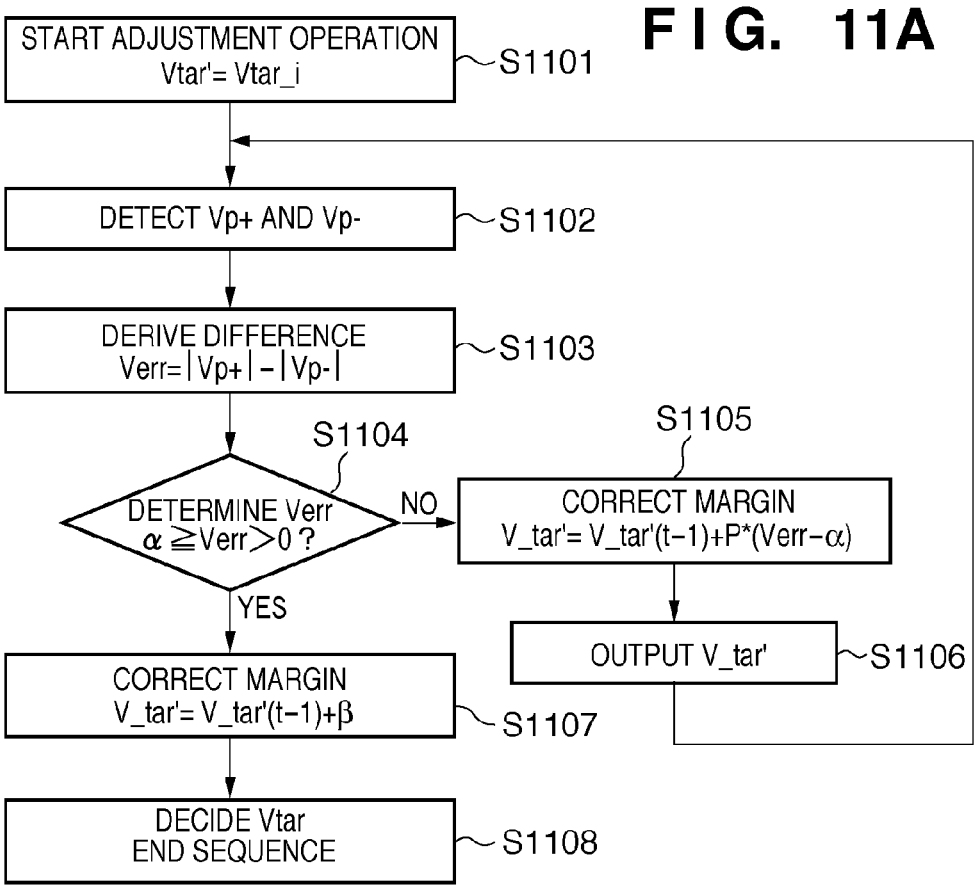
FIG. 11A is a flowchart showing the processing sequence of a computing unit 1001 according to the second embodiment.

FIG. 11A is a flowchart for explaining the adjustment sequence flow according to the second embodiment. At the time of a copy operation instruction, the computing unit 1001 instructs an initial target value V_tar'_i as a charging alternating voltage prior to the beginning of an actual image forming operation (S1101). V_tar'_i is a value which is sufficiently smaller than Vac_s and results in Vdc>Vd. The computing unit 1001 fetches Vp+ and Vp− values of an output voltage corresponding to V_tar'_i from an AD converter 611 (S1102). The computing unit 1001 derives a difference Verr between the fetched Vp+ and Vp− (S1103). Then, the computing unit 1001 determines a magnitude relationship as to whether or not α≧Verr>0 (S1104).

If α<Verr, the computing unit 1001 raises an alternating voltage amplitude target value V_tar' by a magnitude proportional to a difference between Verr and α. If 0>Verr, the computing unit 1001 lowers the alternating voltage amplitude target value V_tar' by a magnitude proportional to a difference between Verr and α. That is, the computing unit 1001 controls to attain Verr=α (S1105). The computing unit 1001 outputs the derived new target value V_tar' to a DA converter 602 (S1106). Then, the process returns to step S1102 to form a feedback loop including a power supply. The computing unit 1001 controls to attain Verr=α.

If α≧Verr >0 in step S1104, the computing unit 1001 determines that a voltage amplitude is controlled to Vac corresponding to Vd≈Vdc, and decides V_tar' added with an adjustment voltage (margin β) required to adjust an amplitude value of an alternating voltage. The computing unit 1001 determines a magnitude relationship between a difference between positive and negative peak voltages and a predetermined value α. As a result of determination, if the difference becomes less than or equal to the predetermined value, the computing unit 1001 decides the target amplitude value of the alternating voltage by adding the adjustment voltage (margin β) required to adjust the amplitude value (S1107). Then, the computing unit 1001 outputs the controlled V_tar' to the DA converter 602, thus ending the adjustment sequence (S1108).

Figure 11B:
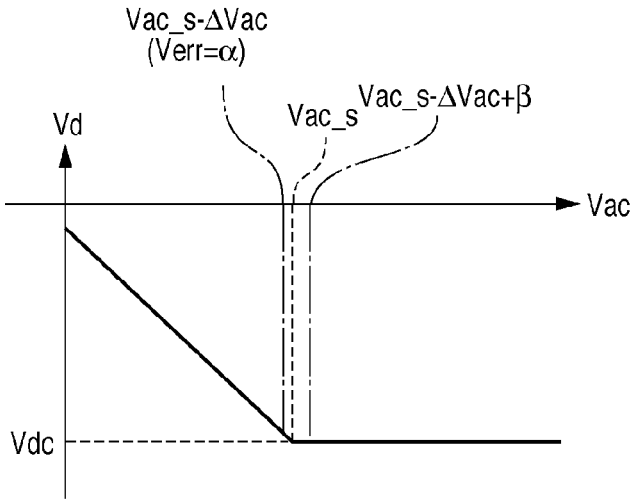
FIG. 11B is a graph for explaining an alternating voltage controlled by the computing processing shown in the flowchart of FIG. 11A.

After completion of the adjustment sequence, the control enters an image forming operation to have V_tar' decided by the sequence shown in FIG. 11A as the alternating voltage amplitude target value. An alternating output voltage decided by the computing processing shown in the flowchart of FIG. 11A is Vac_s−ΔVac+β shown in FIG. 11B.

A charging high-voltage circuit according to this embodiment achieves the following effects.

(1) Since Vac does not require a magnitude of Vac_s+β+ΔV or more even in consideration of overshoot in terms of control, an output power supply circuit having a performance more than an output used in the image forming sequence for Vac adjustment is not required.

(2) Since control target values are the setting values (fixed values) α and β which do not depend on environments and variations, simple feedback control can be attained. For this reason, a voltage amplitude having a margin with respect to Vac_s can be decided by the adjustment sequence without any storage unit and complicated arithmetic operations, and an appropriate charging potential Vd can be obtained.

As the adjustment execution timing using the adjustment voltage β, for example, the computing unit 1001 can control an amplitude value using the adjustment voltage before a copy instruction is received and image formation based on an image forming process starts.

The adjustment using the adjustment voltage β is not limited to the aforementioned timing. For example, when the accumulated number of print sheets that have undergone print processing reaches a predetermined count during execution of the print processing, the print processing is temporarily interrupted, and the adjustment using the adjustment voltage β can be executed.

Also, when a plurality of print jobs are successively input, the adjustment using the adjustment voltage β can be executed after completion of a preceding print job and before the beginning of a succeeding print job.

Alternatively, environmental changes such as a temperature and humidity in an image forming apparatus may be respectively detected using sensors, and the adjustment sequence may be executed to have these detection results as conditions. Furthermore, the adjustment sequence may be executed at a timing that does not require image formation (e.g., a timing at which a print sheet is conveyed between a photosensitive member 1 and secondary transfer rollers 56 and 57 during a charging operation). Moreover, the adjustment may be executed after power-ON of the image forming apparatus.

According to this embodiment, high image quality and high quality can be stably maintained over the long term by applying an alternating voltage of a satisfactory amplitude to the charging roller irrespective of characteristics variations and the like of the charging member due to environmental conditions and manufacture.

Other Embodiments

In the first and second embodiments, the peak positive voltage Vp+ and the peak negative voltage Vp− are detected and the amplitude of the alternating voltage is controlled based on the peak positive and negative voltages Vp+ and Vp−. However, it is not essential to control the amplitude of the alternating voltage based on Vp+ and Vp−. The positive-going and negative-going elements of the AC component of the charging-member potential can be compared in other ways, too. For example, any suitable first measure can be produced for the positive-going elements and any suitable second measure can be produced for the negative-going elements. The amplitude of the alternating voltage can then be controlled based on a result of a comparison between the first and second measures, for example the difference between the two measures. The first measure could be the area of a positive-going element (integral of its amplitude over time). The second measure could be the area of a negative-going element (integral of its amplitude over time). Referring to FIGS. 8B to 8D, it can be seen that the area under the curves in FIGS. 8B and 8C is smaller for positive-going elements than for negative-going elements, whereas in FIG. 8D the areas are substantially equal. In another embodiment the first measure could be the time for which the AC component is positive, and the second measure could be the time for which the AC component is negative.

It is also not essential to produce a first measure for the positive-going elements and a second measure for the negative-going elements. A single measure could be produced to compare the positive- and negative-going elements. One suitable measure of this kind could be the average of the AC component over one cycle, or over an integral number of cycles. When the positive- and negative-going elements are equal the average value of the AC component will be zero.

In the first and second embodiments, the charging member is AC-coupled to the peak detection circuits 609 and 610. This has the advantage that the peak detection circuits do not need not to be capable of withstanding such high potentials as would be the case if DC coupling were used. Also, the AC component of the charging-member potential can be measured directly, without having to subtract from the measured potentials the DC component Vdc. However, in other embodiments it is possible to DC couple the charging member to the circuitry which compares positive- and negative-going elements of the AC component of the charging-member potential or current. In this case, the circuitry could comprise simply an ADC circuit to enable the computing unit 601 to input digital values of Vac+Vdc (or Iac+Idc) over time. From the input digital values, and with knowledge of Vdc (or Idc), the computing unit 601 could obtain the peak positive and negative values of Vac (or Iac). Similarly, from the input digital values the computing unit 601 could calculate the average value of Vac+Vdc over one or more cycles and determine whether the average value differs from Vdc by more than a predetermined value. In these ways, the same effects as in the first and second embodiments can be obtained.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-151520, filed Jun. 25, 2009, which is hereby incorporated by reference herein in its entirety.

What is claimed is:

1. An image forming apparatus comprising:

an image carrier;

a charging member arranged to be in contact with the image carrier;

an AC voltage applying unit adapted to apply an AC voltage to the charging member;

a comparison unit adapted to compare an absolute value of positive peak voltage and an absolute value of negative peak voltage of an AC component of a potential (V) of the charging member, or of a current flowing through the charging member, when the AC voltage is applied thereto; and an AC voltage control unit adapted to control an amplitude of the AC voltage based on a difference between the absolute value of the positive peak voltage and the absolute value of the negative peak voltage.

2. The apparatus according to claim 1, wherein the AC voltage control unit controls the amplitude of the AC voltage so that a difference between the absolute value of the positive peak voltage and the absolute value of the negative peak voltage equals a predetermined value.

3. The apparatus according to claim 1, further comprising a DC voltage applying unit adapted to apply a DC voltage to the charging member at the same time as the AC voltage is applied by the AC voltage applying unit.

4. The apparatus according to claim 3, wherein the AC voltage control unit is adapted to control the amplitude of the AC voltage so that a positive waveform and a negative waveform of the AC component are substantially symmetrical with respect to a DC component (Vdc) of the charging-member potential.

5. The apparatus according to claim 1, wherein the AC voltage applying unit is adapted to generate the AC voltage according to an input voltage value, and the AC voltage control unit is adapted to control the voltage value input to the AC voltage applying unit.

6. An image forming apparatus comprising:

an image carrier;

a charging member arranged to be in contact with the image carrier;

an AC voltage applying unit adapted to apply an AC voltage to the charging member;

a comparison unit adapted to compare positive-going and negative-going elements (Vp+, Vp−) of an AC component of a potential (V) of the charging member, or of a current flowing through the charging member, when the AC voltage is applied thereto; and an AC voltage control unit adapted to control an amplitude of the AC voltage based on a result of the comparison by the comparison unit, wherein the comparison unit is adapted to produce a first measure (|Vp+|) dependent on at least one of the positive-going elements and to produce a second measure (|Vp−|) dependent on at least one of the negative-going elements, and the AC voltage control unit is adapted to control the amplitude of the AC voltage based on a difference (Verr) between the first and second measures.

7. The apparatus according to claim 6, wherein the AC voltage control unit is adapted to adjust the amplitude of the AC voltage by a variable adjustment amount (P*(Verr-α)) dependent upon the difference (Verr), wherein P is a proportional gain and α is a predetermined value.

8. The apparatus according to claim 7, wherein the variable adjustment amount is dependent upon how much the difference (Verr) differs from the predetermined value (α).

9. The apparatus according to claim 7, wherein the AC voltage control unit is adapted to adjust the amplitude of the AC voltage by the variable adjustment amount when the difference is outside a target range (α≧Verr>0) and is adapted to adjust the amplitude by a fixed adjustment amount (β) when the difference is within the target range.

10. The apparatus according to claim 7, wherein the AC voltage control unit is adapted to adjust the amplitude of the AC voltage by the variable adjustment amount (P*(Verr-α)) after image formation is started and during a charging operation and is adapted to adjust the amplitude by a fixed adjustment amount (β) before image formation is started.

11. The apparatus according to claim 6, wherein the AC voltage applying unit is adapted to generate the AC voltage according to an input voltage value, and the AC voltage control unit is adapted to control the voltage value input to the AC voltage applying unit.

12. An image forming apparatus comprising:

an image carrier;

a charging member arranged to be in contact with the image carrier;

an AC voltage applying unit adapted to apply an AC voltage to the charging member;

a comparison unit adapted to compare positive-going and negative-going elements (Vp+, Vp−) of an AC component of a potential (V) of the charging member, or of a current flowing through the charging member, when the AC voltage is applied thereto; and an AC voltage control unit adapted to control an amplitude of the AC voltage based on a result of the comparison by the comparison unit, wherein the AC voltage control unit is adapted to control the amplitude of the AC voltage so that a difference (Verr) between a positive peak voltage and a negative peak voltage of the AC component is no more than a predetermined value (α).

13. An image forming apparatus comprising:

an image carrier;

a charging member arranged to be in contact with the image carrier;

an AC voltage applying unit adapted to apply an AC voltage to the charging member;

a comparison unit adapted to compare positive-going and negative-going elements (Vp+, Vp−) of an AC component of a potential (V) of the charging member, or of a current flowing through the charging member, when the AC voltage is applied thereto; and an AC voltage control unit adapted to control an amplitude of the AC voltage based on a result of the comparison by the comparison unit, wherein the comparison unit is adapted to produce a measure dependent on a difference between at least one of the positive-going elements and at least one of the negative-going elements, and the AC voltage control unit is adapted to control the amplitude of the AC voltage based on the measure.

14. An image forming apparatus comprising:

an image carrier;

a charging member arranged to be in contact with the image carrier;

an AC voltage applying unit adapted to apply an AC voltage to the charging member;

a comparison unit adapted to compare positive-going and negative-going elements (Vp+, Vp−) of an AC component of a potential (V) of the charging member, or of a current flowing through the charging member, when the AC voltage is applied thereto;

an AC voltage control unit adapted to control an amplitude of the AC voltage based on a result of the comparison by the comparison unit; and a DC voltage applying unit adapted to apply a DC voltage to the charging member at the same time as the AC voltage is applied by the AC voltage applying unit, wherein the AC voltage control unit is adapted to control the amplitude of the AC voltage so that the positive-going elements and the negative-going elements of the AC component are substantially symmetrical with respect to a DC component (Vdc) of the charging-member potential or current.

15. The apparatus according to claim 14, wherein the AC voltage control unit is adapted to control the amplitude of the AC voltage so that a first amount (Vp+), by which a maximum value of the charging-member potential exceeds the DC voltage, differs by no more than a predetermined value (α) from a second amount (Vp−) by which the DC voltage exceeds a minimum value of the charging-member potential.

16. A method of controlling an image forming apparatus having an image carrier and a charging member arranged to be in contact with the image carrier, the method comprising:

applying an AC voltage to the charging member;

comparing an absolute value of positive peak voltage and an absolute value of negative peak voltage of an AC component of a potential (V) of the charging member, or of a current flowing through the charging member, when the AC voltage is applied thereto; and controlling an amplitude of the AC voltage based on a difference between the absolute value of the positive peak voltage and the absolute value of the negative peak voltage.

* * * * *